US007083560B2

(12) United States Patent
Kobben et al.

(10) Patent No.: US 7,083,560 B2
(45) Date of Patent: Aug. 1, 2006

(54) CUSHIONING CONVERSION MACHINE HAVING HEAVY DUTY CHARACTERISTICS

(75) Inventors: Pierre H. G. Kobben, Kerkrade (NL); Roger P. M. Rinkens, Schinveld (NL); Herman R. L. Van Heumen, Heerlen (NL)

(73) Assignee: Ranpak Corp., Concord Township, OH (US)

( * ) Notice: Subject to any disclaimer, the term of this patent is extended or adjusted under 35 U.S.C. 154(b) by 941 days.

(21) Appl. No.: 10/087,613

(22) Filed: Mar. 1, 2002

(65) Prior Publication Data

US 2002/0137617 A1 Sep. 26, 2002

Related U.S. Application Data

(63) Continuation of application No. PCT/US00/24193, filed on Sep. 1, 2000.

(60) Provisional application No. 60/152,299, filed on Sep. 3, 1999.

(51) Int. Cl.
*B31F 1/12* (2006.01)

(52) U.S. Cl. ..... 493/407; 493/372; 493/416; 493/464; 493/967

(58) Field of Classification Search ..... 493/357, 493/416, 352, 346, 372, 967, 407, 464
See application file for complete search history.

(56) References Cited

U.S. PATENT DOCUMENTS 1,869,545 A 8/1932 Crafts
2,699,331 A * 1/1955 McGarvey ..... 493/421
2,882,802 A 4/1959 Walker (Continued)

FOREIGN PATENT DOCUMENTS

GB 2332192 6/1999

(Continued)

OTHER PUBLICATIONS

European Search Report for counterpart European Patent Application No. 00961511.3.

*Primary Examiner*—John Sipos
*Assistant Examiner*—Christopher Harmon
(74) *Attorney, Agent, or Firm*—Renner, Otto, Boisselle & Sklar, LLP.

(57) ABSTRACT

A cushioning conversion machine for converting multi-ply stock material is characterized by a conversion assembly which comprises one or more assemblies and/or devices for converting multi-ply stock material into a three-dimensional cushioning product and a stock supply assembly for providing stock material to the conversion assembly. The stock supply assembly includes a stock roll holder assembly having one or more rotatable roll support members that extend transverse to the path of the stock material and engage an outer periphery of a stock roll for advancing the stock material therefrom. A connecting assembly includes a carrier pivotally mounted to a frame for urging a first rotating feed member toward and away from a second rotating feed member. A severing assembly includes a movable blade having a first end pivotally coupled to a motion crank for providing circular motion of the first end, and a second end including a sliding mechanism for providing slidable movement of the second end, the blade being movable between an open position and a closed position. A shutter device includes a pair of eccentric rollers disposed substantially parallel to one another thereby forming a gap between the rollers that, upon rotation of the eccentric rollers, varies between an open position for permitting passage therethrough of the dunnage material in one direction and a closed position that inhibits foreign objects from entering the severing zone of the machine in the other direction.

8 Claims, 15 Drawing Sheets

U.S. PATENT DOCUMENTS

| | | | | | |
|---|---|---|---|---|---|
| 3,089,695 | A | * | 5/1963 | Brooks | 493/419 |
| 3,154,263 | A | | 10/1964 | Fischer, Jr. et al. | |
| 3,613,522 | A | * | 10/1971 | Johnson | 493/297 |
| 4,032,133 | A | * | 6/1977 | Steffens et al. | 493/421 |
| 4,125,254 | A | * | 11/1978 | Boyer | 493/8 |
| 5,123,889 | A | | 6/1992 | Armington et al. | |
| 5,236,408 | A | * | 8/1993 | McAdam et al. | 493/355 |
| 5,546,993 | A | | 8/1996 | Summey, III et al. | |
| 5,871,429 | A | | 2/1999 | Harding et al. | |
| 5,873,809 | A | * | 2/1999 | Kempster et al. | 493/464 |
| 5,876,027 | A | * | 3/1999 | Fukui et al. | 270/51 |
| 5,876,320 | A | * | 3/1999 | LeCompte | 493/125 |
| 5,906,569 | A | * | 5/1999 | Ratzel | 493/363 |
| 6,179,765 | B1 | * | 1/2001 | Toth | 493/360 |
| 6,554,511 | B1 | * | 4/2003 | Kwasny et al. | 400/621 |

FOREIGN PATENT DOCUMENTS

| | | |
|---|---|---|
| WO | WO95/28276 | 10/1995 |
| WO | WO96/40496 | 12/1996 |
| WO | WO97/01434 | 1/1997 |

* cited by examiner

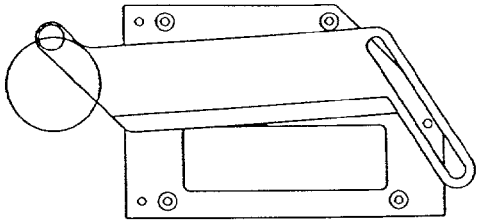
Fig. 13/1
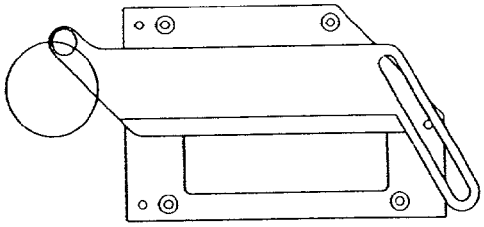
Fig. 13/2
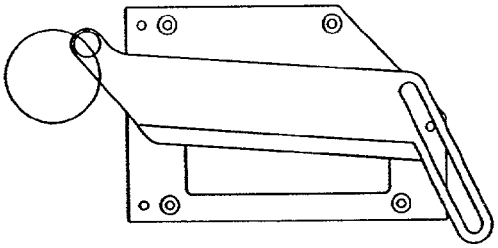
Fig. 13/3
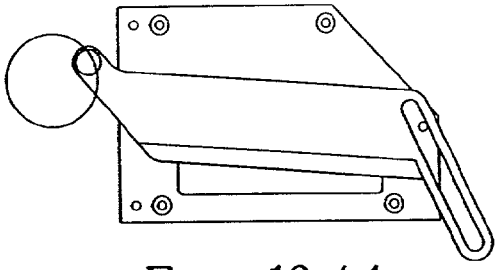
Fig. 13/4
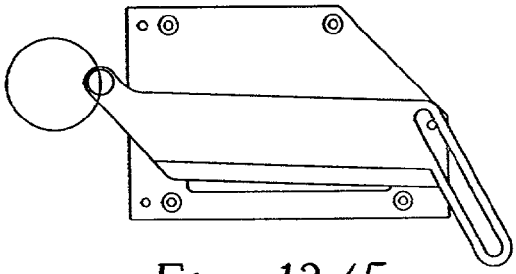
Fig. 13/5
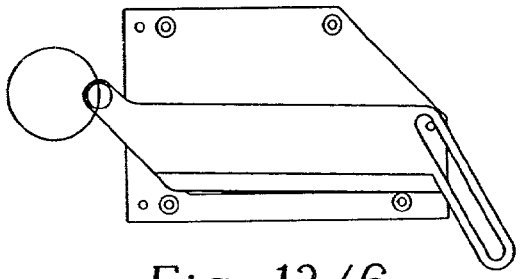
Fig. 13/6
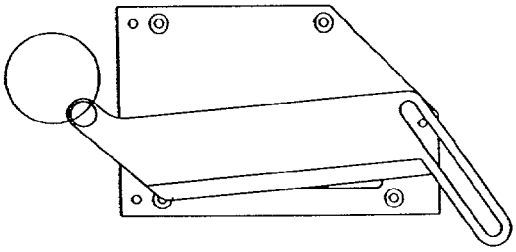
Fig. 13/7
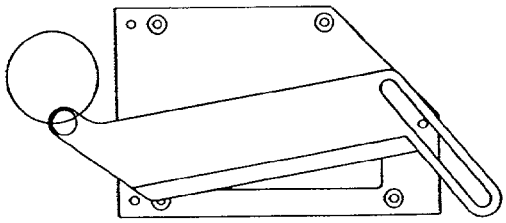
Fig. 13/8

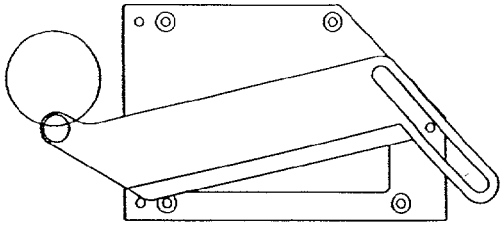
Fig. 13/9
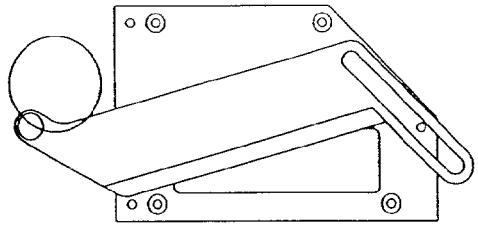
Fig. 13/10
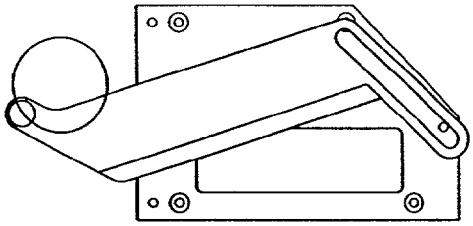
Fig. 13/11
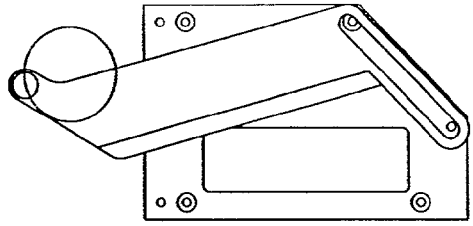
Fig. 13/12
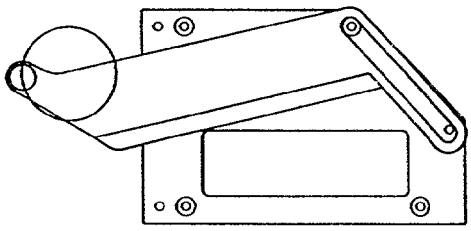
Fig. 13/13
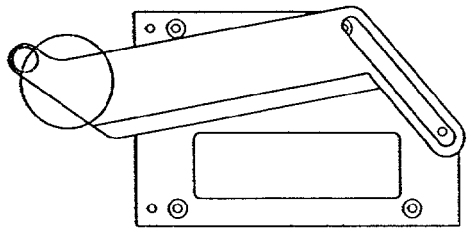
Fig. 13/14
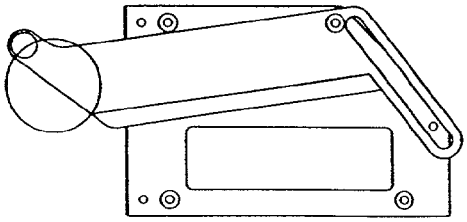
Fig. 13/15
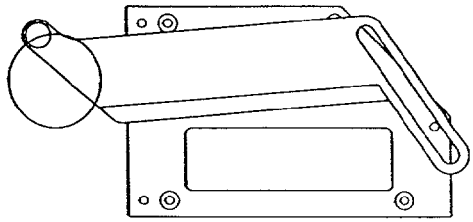
Fig. 13/16

CUSHIONING CONVERSION MACHINE HAVING HEAVY DUTY CHARACTERISTICS

RELATED APPLICATION DATA

The present application is a continuation of prior International Patent Application No. PCT/US00/24193, filed Sep. 1, 2000, which claims priority from U.S. Provisional Application No. 60/152,299, filed Sep. 3, 1999, the entire disclosures of which are hereby incorporated herein by reference.

FIELD OF THE INVENTION

The invention herein described relates generally to a cushioning conversion machine for producing a dunnage product from sheet-like stock material supplied, for example, in roll form and, more particularly, to an improved construction of such machine which enables, among other things, the conversion of heavy grade stock material.

BACKGROUND OF THE INVENTION

In the process of shipping an item from one location to another, protective packaging material is often placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and plastic foam peanuts is their effect on our environment. Quite simply, these plastic packaging materials are not biodegradable, and therefore they cannot avoid further multiplying our planet's already critical waste disposal problems. The nonbiodegradability of these packaging materials has become increasingly important in light of many industries adopting more progressive policies in terms of environmental responsibility.

The foregoing and other disadvantages of conventional plastic packaging materials have made paper protective packaging material a popular alternative. Paper is biodegradable, recyclable and composed of a renewable resource, making it an environmentally responsible choice for conscientious shippers.

While paper in sheet form could possibly be used as a protective packaging material, it is usually preferable to convert the sheets of paper into a relatively low density pad-like cushioning or dunnage product. This conversion may be accomplished by a cushioning conversion machine, such as that disclosed in commonly assigned U.S. Pat. No. 5,123,889. The conversion machine disclosed in U.S. Pat. No. 5,123,889 converts sheet-like stock material, such as paper in multi-ply form, into relatively low density pads. Specifically, the machine converts this stock material into a continuous unconnected strip having lateral pillow-like portions separated by a thin central band. This strip is connected as by coining along its central band to form a coined strip which is cut into sections, or pads, of a desired length. The stock material preferably consists of three superimposed webs or layers of biodegradable, recyclable and reusable thirty-pound Kraft paper rolled onto a hollow cylindrical tube to form a stock roll.

The several embodiments of machines shown in the aforesaid patent and other commonly assigned patents and applications have achieved considerable commercial success. Nevertheless, environmental and other concerns generally create a continuing need for further improvements in such machines. Also, there appears to be a specific need for a machine which can be economically used to produce a heavier pad than which could otherwise be produced by such earlier machines. Additionally or alternatively, a specific need exists for a machine that can handle the rigors associated with converting a heavier grade sheet stock material that may be used for constructing such a pad, as well as improvements more generally providing for improved performance, lower cost, easier maintenance and repair, etc.

SUMMARY OF THE INVENTION

The present invention provides a novel dunnage-creating machine and related methodology wherein various features of the invention may be individually or collectively used in dunnage-creating machines of various types, although they lend themselves particularly to the provision of relatively heavier duty machines which can be economically used to produce a relatively heavier pad than which could otherwise be produced by the above mentioned earlier machines. Various aspects of the invention are hereinafter summarized and more fully described below.

According to one aspect of the invention, there is provided a cushioning conversion machine including a conversion assembly which converts sheet stock material into a three-dimensional cushioning product and a stock supply assembly for supplying stock material to the conversion assembly. The stock supply assembly is operative to advance the stock material to the conversion assembly at a substantially constant supply rate.

In one specific embodiment of the invention, the stock supply assembly includes a stock roll holder assembly for supporting a roll of sheet stock material. The stock roll holder assembly includes one or more rotatable roll support members that extend transverse to the path of the stock material and engage an outer periphery of the stock roll. One or more of the rotatable roll support members are driven for rotating the stock roll to feed the stock material therefrom. Preferably, the rotatable roll support members include rollers that extend substantially the full width of the stock roll to support the stock roll across its full width. A motion transmitting assembly may be used for driving one or more of the rotatable roll support members at a substantially constant rate thereby feeding the stock material at a substantially constant rate.

In another specific embodiment of the invention, the stock roll holder assembly includes a pair of stock roll guide members for holding the stock roll on the rotatable roll support members. The guide members may take the form of end plates disposed adjacent to the respective side edge portions of the stock roll and to which the rotatable roll support members may be mounted. The guide members preferably include respective guideways, for example, slots, for slidably receiving therein stock roll end guides coaxial with and projecting from the ends of the stock roll.

In yet another specific embodiment of the invention, a feed motor is provided for feeding the stock material through the conversion assembly at a first rate and the stock supply assembly includes a supply motor for driving the stock roll holder for supplying the stock material at a second rate. The second rate may be faster than the first rate so as to form a loop in the stock material as the stock material travels from the stock supply assembly to the conversion assembly. To this end, the stock supply assembly preferably further includes a sensor for detecting a size of the loop and a controller for controlling the first and second rates of the motors in response to an input from the sensor for maintaining a prescribed loop size.

According to another aspect of the invention, a conversion assembly of a cushioning conversion machine comprises a connecting assembly including a frame and first and second rotating feed members. The first feed member is mounted in a carrier pivotally mounted to the frame and the carrier is resiliently biased for urging the first rotating member carried thereby towards the second rotating member.

In a specific embodiment of the invention, the carrier is pivotally connected to a pivot shaft and rotatably supports an idler shaft, the idler shaft having the first rotating feed member carried thereon. A driving shaft may be rotatably mounted to the frame and may have the second rotating feed member carried thereon. Preferably, the carrier is resiliently biased to urge the idler shaft and the first feed member carried thereon toward the driving shaft and the second feed member carried thereon so as to apply a pinch force to stock material being fed between the feed members.

In another specific embodiment of the invention, the carrier is selectively adjustable in such a manner that the idler shaft is movable towards and away from the driving shaft for adjusting the distance between the first rotating feed member and the second rotating feed member.

In still another preferred embodiment of the invention, a mounting assembly is provided that is movable between a locked condition whereat the carrier may pivot about the frame over a prescribed angular range against the resilient biasing force acting on the carrier, and a released condition whereat the mounting assembly is free to pivot about the frame and carry along with it the carrier for enabling free separation of the rotating feed members. A biasing member may be interposed between the carrier and mounting assembly for resiliently biasing the carrier relative to the mounting assembly thereby to urge the first rotating feed member toward the second rotating feed member. The biasing member may be, for example, a coil spring, leaf spring, etc.

According to yet another aspect of the invention, a conversion assembly of a conversion machine includes a severing assembly operative to sever the continuous strip of dunnage into sections of a desired length after a length of the continuous strip has passed through the conversion assembly. The severing assembly includes a movable blade mounted to a coacting member having a severing edge. The movable blade is in sliding engagement with the coacting member and may be moved between an open position whereat a strip of dunnage may pass between the movable blade and severing edge and a closed position whereat the movable blade coacts with the severing edge of the coacting member thereby to sever the strip of dunnage. A first end of the movable blade is pivotally coupled to a motion crank for providing circular motion of the first end. A second end of the movable blade having a mechanism for providing a translating pivoting movement of the second end.

In a specific embodiment, the movable blade is movable in a plane parallel to the plane defined by the sliding engagement between the movable blade and the coacting member. A motor connects to a shaft which rotates the motion crank which transmits circular motion to the first end and a translating pivoting motion to the second end of the movable blade. The combination of the circular motion and the translating pivoting motion is operative to move the blade between its open position and its closed position.

In another specific embodiment of the invention, the sliding mechanism includes a pin-slot mechanism. More particularly, the second end of the movable blade includes a slot and the coacting member includes a pin slidably received in the slot for guiding movement of the second end along the path defined by the slot while permitting pivoting movement of the movable blade about the translating axis of the pin. The severing edge may be formed by a side of an opening through which the strip of dunnage passes. A guide bar may be mounted on the coacting member to hold and preferably resiliently bias the movable blade against the coacting member.

According to yet another aspect of the invention, an exit chute is disposed downstream of a severing assembly for receiving therein a severed strip of dunnage. A shutter device is disposed at a downstream portion of the exit chute, and includes a pair of eccentric rollers disposed substantially parallel to one another thereby forming a gap between the rollers that upon rotation of the eccentric rollers varies between an open position for permitting free passage therethrough of the dunnage material and a closed position that inhibits foreign objects from entering the exit chute of the machine.

In a specific embodiment of the invention, the eccentric rollers may be driven via a motor coupled to a motion transfer assembly. Preferably, the motion transfer assembly includes a flexible transfer element that is operative to rotate one of the rollers clockwise and the other of the rollers counterclockwise.

In another specific embodiment of the invention, the shutter device includes one or more switches for detecting whether the eccentric rollers are in an position or a closed position. The shutter device may also include a photocell detector for detecting the presence of a strip of cushioning product in relatively close proximity to the shutter device.

The foregoing and other features of the invention are hereinafter fully described and particularly pointed out in the claims, the following description and the annexed drawings setting forth in detail one or more illustrative embodiments of the invention, such being indicative, however, of but one or a few of the various ways in which the principles of the invention may be employed.

BRIEF DESCRIPTION OF THE DRAWINGS

FIG. 13/1 to 13/16 show a plurality of views of the severing assembly of FIG. 11 illustrating the sequential operation thereof.

DETAILED DESCRIPTION

Figure 1:
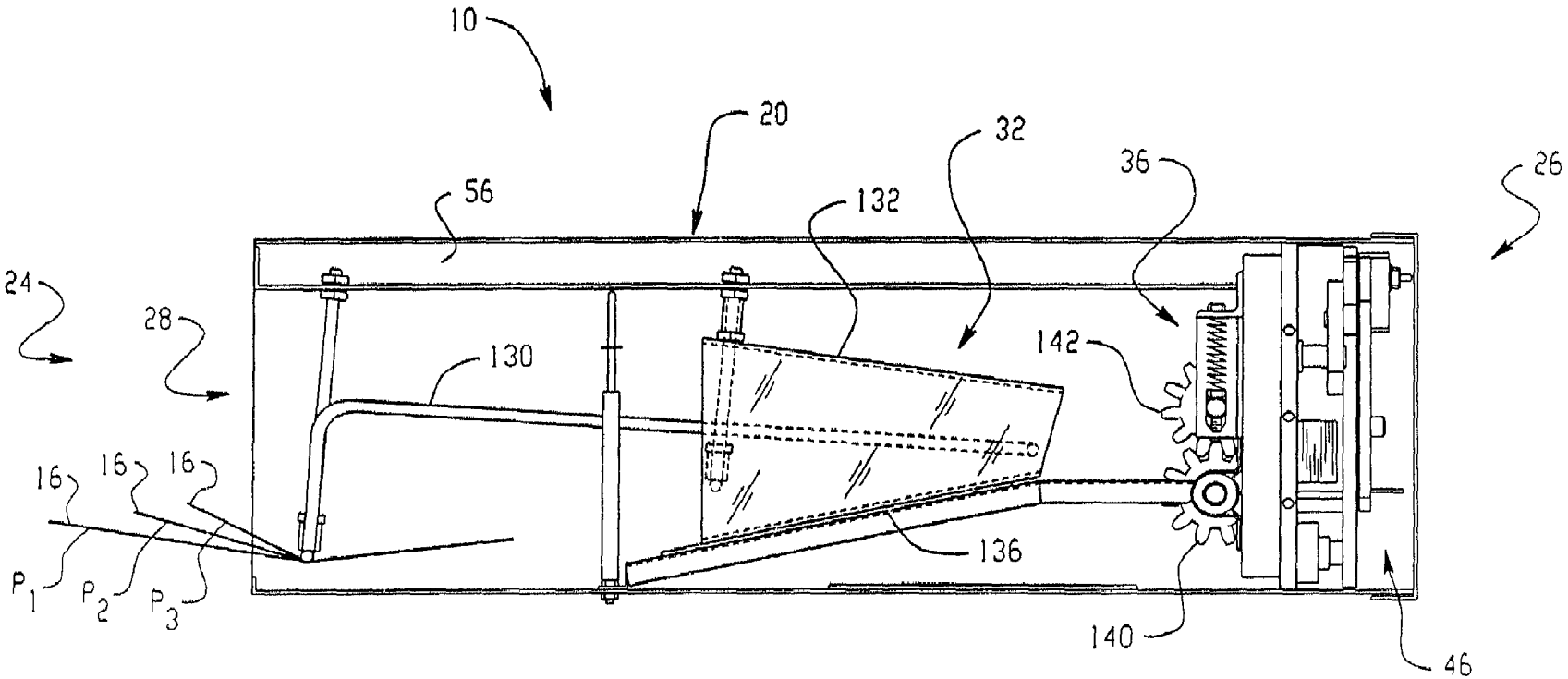
FIG. 1 is a side elevational schematic view of a cushioning conversion machine, the machine being shown in a horizontal orientation with a housing side wall removed for viewing interior components.
Figure 2:
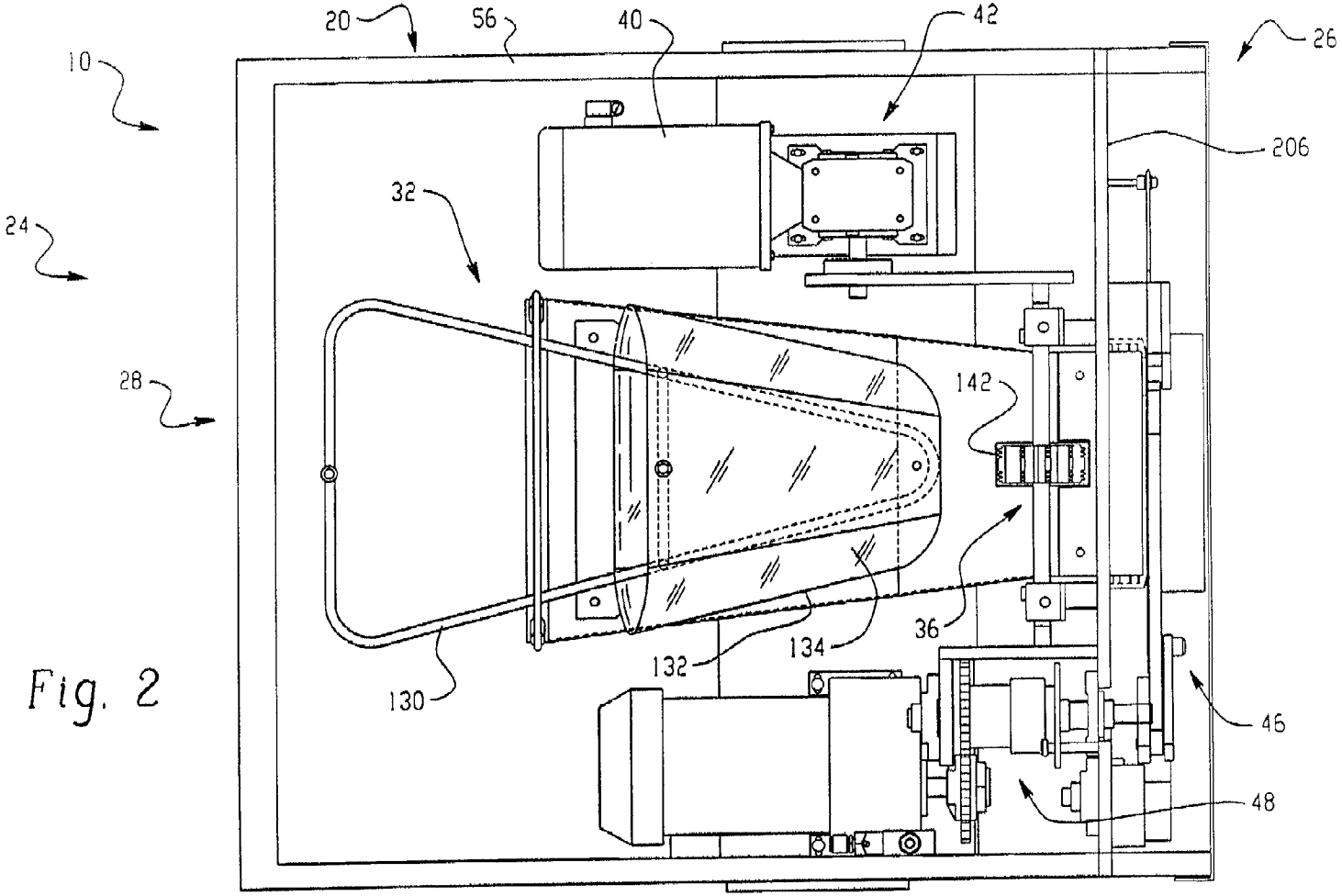
FIG. 2 is a top plan view of the cushioning conversion machine of FIG. 1, with a housing top wall removed for viewing interior components.
Figure 3:
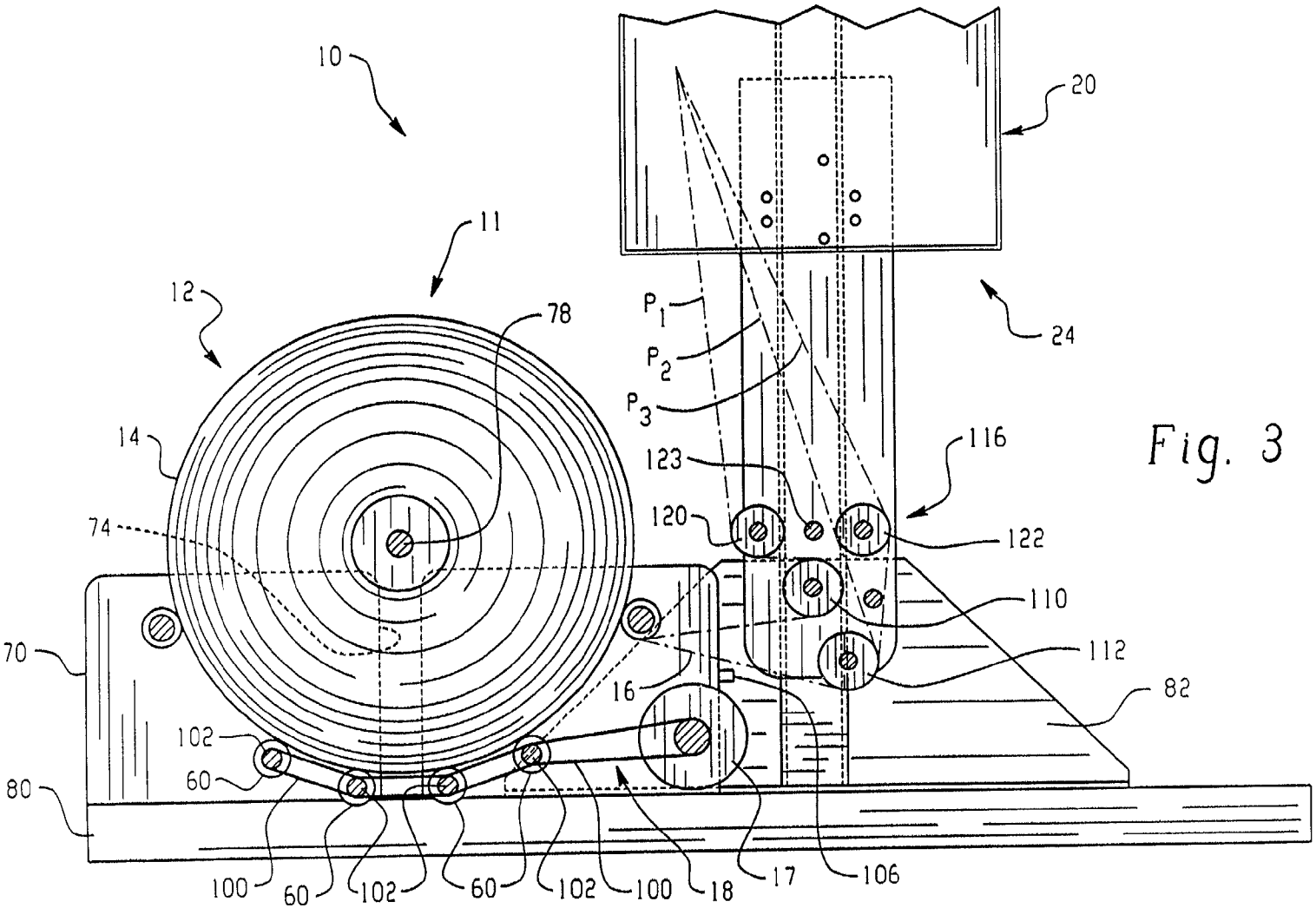
FIG. 3 is a schematic side elevational view of a stock supply assembly for the cushioning conversion machine of FIG. 1.

Referring now to the drawings in detail and initially to FIGS. 1 through 3, a cushioning conversion machine is designated generally by reference number 10. The conversion machine 10 converts a sheet-like stock material, such as one or more layers of recyclable and reusable Kraft paper, into a dunnage product having, for example, lateral pillow-like portions separated by a thin central band. The dunnage product is used as an environmentally responsible protective packaging material typically used during shipping.

The conversion machine 10 includes a stock supply assembly 11 (FIG. 3) which includes a stock roll holder assembly 12 for supporting a roll 14 of sheet stock material 16 having one and preferably two or three plies. The stock supply assembly 11 may be provided on a cart or otherwise, although in the illustrated embodiment the stock supply assembly is provided on a stand which is described below. As is described in greater detail below, the stock supply assembly 11.

The stock supply assembly 11 is powered by a motor 17 which drives a motion transfer assembly 18. When then motor is operated, the sheet-like stock material 16 is supplied (fed) to a conversion assembly 20, having an upstream end 24 and a downstream end 26. The sheet-like stock material 16 enters the conversion assembly 20 through an opening 28 at the upstream end thereof for passage through the conversion assembly 20 where it is converted into a strip of cushioning material that exits from the downstream end 26 of the conversion assembly 20 through an exit opening (not shown).

In the illustrated embodiment, the conversion assembly 20 includes a former or forming assembly 32 and a feeding/connecting assembly 36 powered (energized) by a feed motor 40, for example an electric motor, through a motion transfer assembly 42. Downstream of the feeding/connecting assembly 36, there is provided a severing assembly 46, for example, a cutting assembly, for severing the cushioning dunnage product into sections. The severing assembly 46 is powered by suitable means, such as the illustrated motor and motion transfer assembly 48. A shutter device 52 (shown in detail in FIGS. 14–17) is provided downstream of the severing assembly 46. The shutter device 52 permits the cushioning product to be fed out, in one direction, through the exit opening of the conversion machine 10 but inhibits access to the severing assembly 46, in the opposite direction, inwardly through the exit opening. The forming assembly 32, feeding/connecting assembly 36, severing assembly 46 and shutter device 52 are mounted to and/or in a housing 56 in any desired well-known manner. The operation of the conversion machine 10 may be controlled by a known controller, also in a well-known manner. The illustrated and exemplary assemblies and devices, the structure, function and features thereof, and their associated advantages over similar known devices are described in greater detail below.

Referring to FIG. 3, the illustrated stock roll holder assembly 12 includes four rotatable roll support members 60 that engage the outer periphery of the roll 14 of multi-ply stock material 16 to thereby positively advance the stock material 16 to the downstream conversion assembly 20. As described in greater detail below, because the outer diameter, or rather the periphery, of the stock roll 14 is driven, the speed or rate at which the stock material 16 is advanced is constant irrespective of the diameter of the stock roll 14. It will be appreciated that the rate at which the stock material 16 is advanced is substantially equal to the tangential speed of the roll support members 60. Of course, there may be a need for greater or fewer than four roll support members 60 in the event a relatively heavier or lighter stock roll is supported. For example, an alternative embodiment of a stock roll holder assembly 62 (FIG. 4) may have but two roll support members 64. One or more of the roll support members 60 may be driven. In the FIG. 3 stock roll holder, all of the roll support members are driven, as in the manner described below.

The roll support members 60 are preferably cylindrical-shape rollers 60 although alternative types of roll support members may be used to suitably drive the outer periphery of the stock roll 14, such as one or more wheels or even a flexible belt that engages an arcuate lateral portion of the stock roll 14.

The roll support members, or rollers 60, are oriented for supporting, or cradling, the stock roll 14 so that the engagement therebetween relies substantially on gravity-induced friction forces. The engagement is therefore continuous even as the stock material 16 is advanced and the stock roll 14 is consumed and reduced in size. It will be appreciated that the contact between the roll support members 60 and stock roll 14 may be effected by other means such as by a resilient spring bias force that substantially continuously maintains the roll support members 60 in engagement with the stock roll 14 as the stock roll 14 is consumed and reduced in diameter.

Positively engaging the outer periphery of the stock roll 14 assists in control over the rotational inertia effects exhibited by the stock roll 14. Since the engagement is at the outer periphery of the stock roll 14, there is a greater moment arm with which to control the rotational inertia of the stock roll 14 than if the stock roll 14 is driven, for example, at its center axis. This is particularly useful, for example, when a conversion process is stopped and the motor 17 and motion transfer assembly 18 of the stock supply assembly 11 are shut off, in which case the roll support members 60 may operate as brakes to thereby bring the stock roll 14 to a stop.

The roll support members 60 are rotatably mounted at their ends to a pair of laterally spaced apart stock roll guide members 70. The guide members 70 are preferably made of metal plate stock and preferably have a smooth inner surface to facilitate low friction contact between the guide members 70 and side edge portions of the stock roll 14. As the stock roll 14 is rotated and therefore unwound by the driving rollers 60, the guide members 70, in combination with the cradle arrangement of the roll support members 60, maintain the stock roll 14 on the cradle formed by the roll support rollers 60 by inhibiting lateral, or side-to-side, movement of the stock roll 14, which may otherwise cause the stock roll 14 to dance or bounce on the roll support rollers 60. To this end, the guiding effect of the guide members 70 may be optimized by disposing them substantially adjacent to the side edge portions of the stock roll 14.

In the illustrated embodiment the guide members 70 also include a pair of respective guideways, preferably in the form of slots 74. The slots 74 receive therein the respective ends of a supply rod, core tube or other roll end guides 78. The slots 74 are shown vertically disposed and have centerlines that coincide with a plane defined by the vertical center of the cradle formed by the roll support members 60. The cooperation between the slots 74 and the end guides prevents the stock roll 14 from driven out of the cradle. The tendency for the stock roll to be driven out of the cradle increases as its size and weight decrease.

The guide members 70 are mounted to a base member 80, preferably also made of a metal plate material. In the illustrated embodiment, the guide members 70 are positioned adjacent to a triangle-shape support member 82 that supports the conversion assembly 20, which is also secured to the base member 80.

Figure 4:
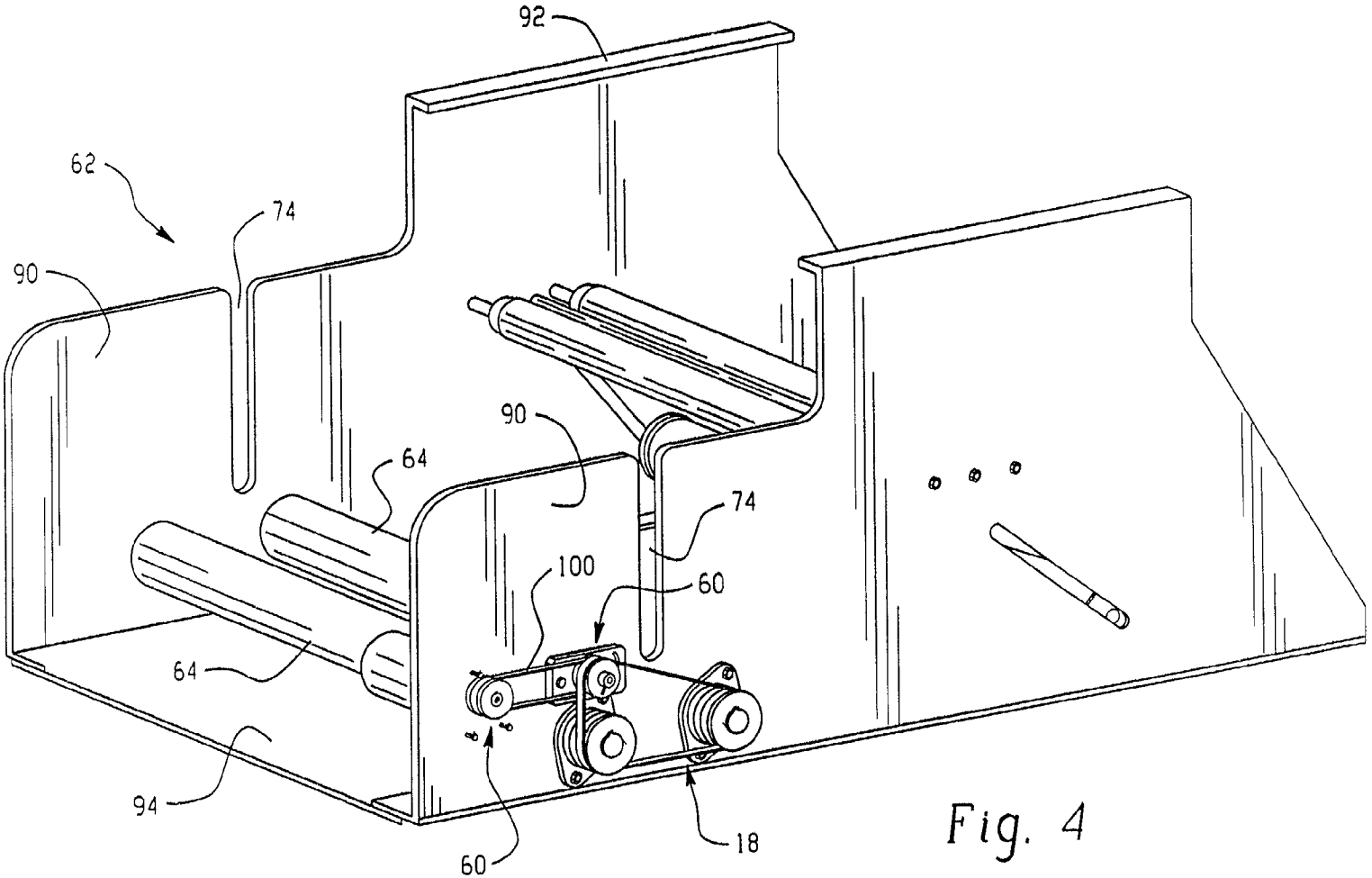
FIG. 4 is a schematic perspective view of another embodiment of a stock supply assembly.
Figure 5:
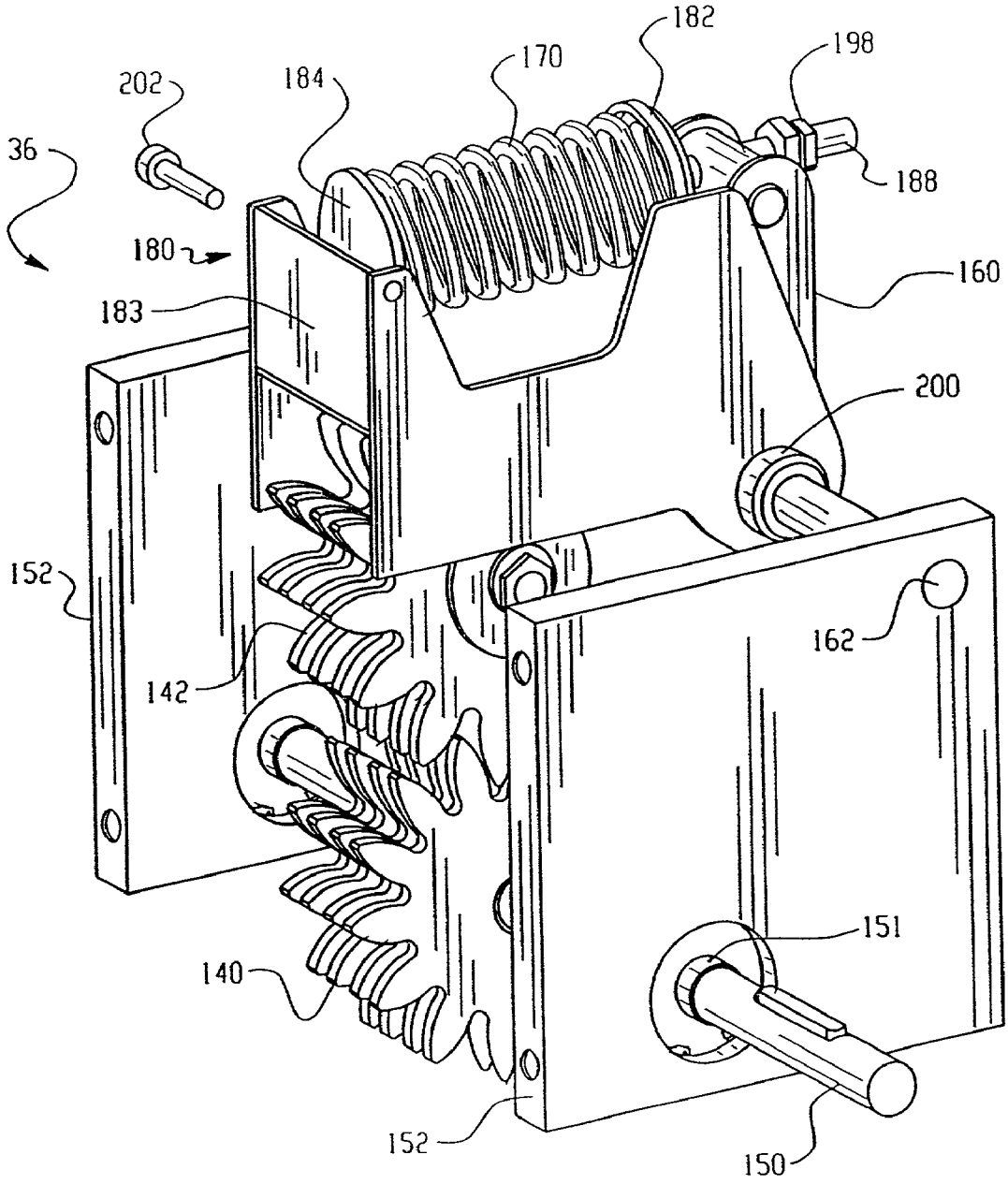
FIG. 5 is a perspective view of a connecting gear assembly that may be employed in the cushioning conversion machine of FIG. 1.
Figure 6:
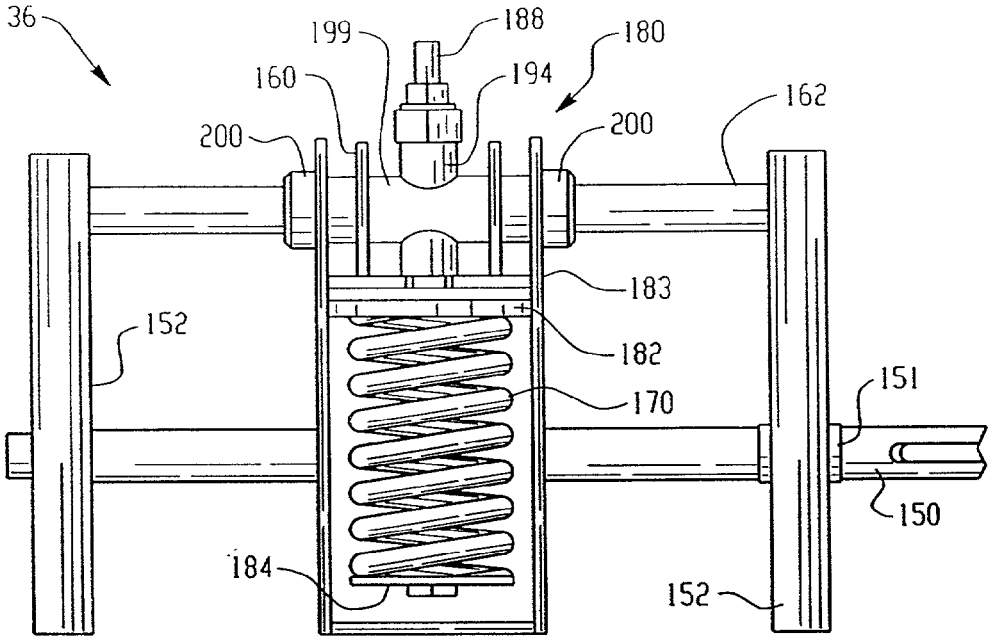
FIG. 6 is a top plan view of the connecting gear assembly of FIG. 5.
Figure 7:
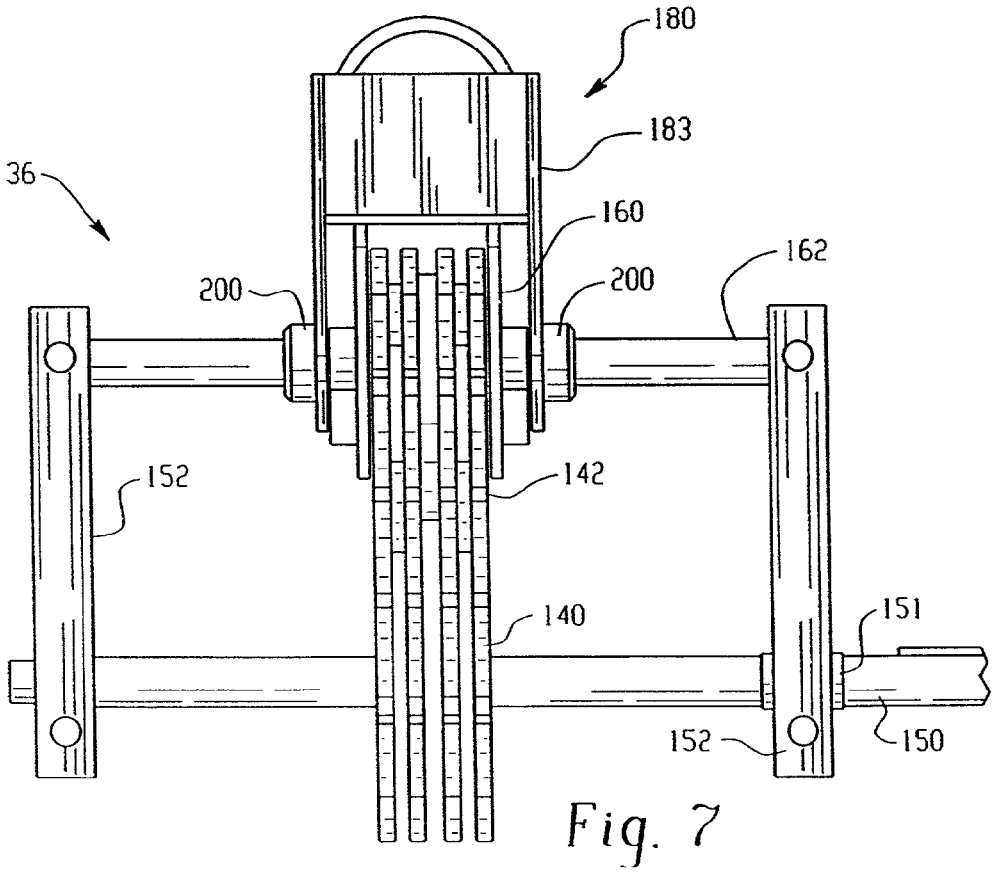
FIG. 7 is an upstream end view of the connecting gear assembly of FIG. 5.
Figure 8:
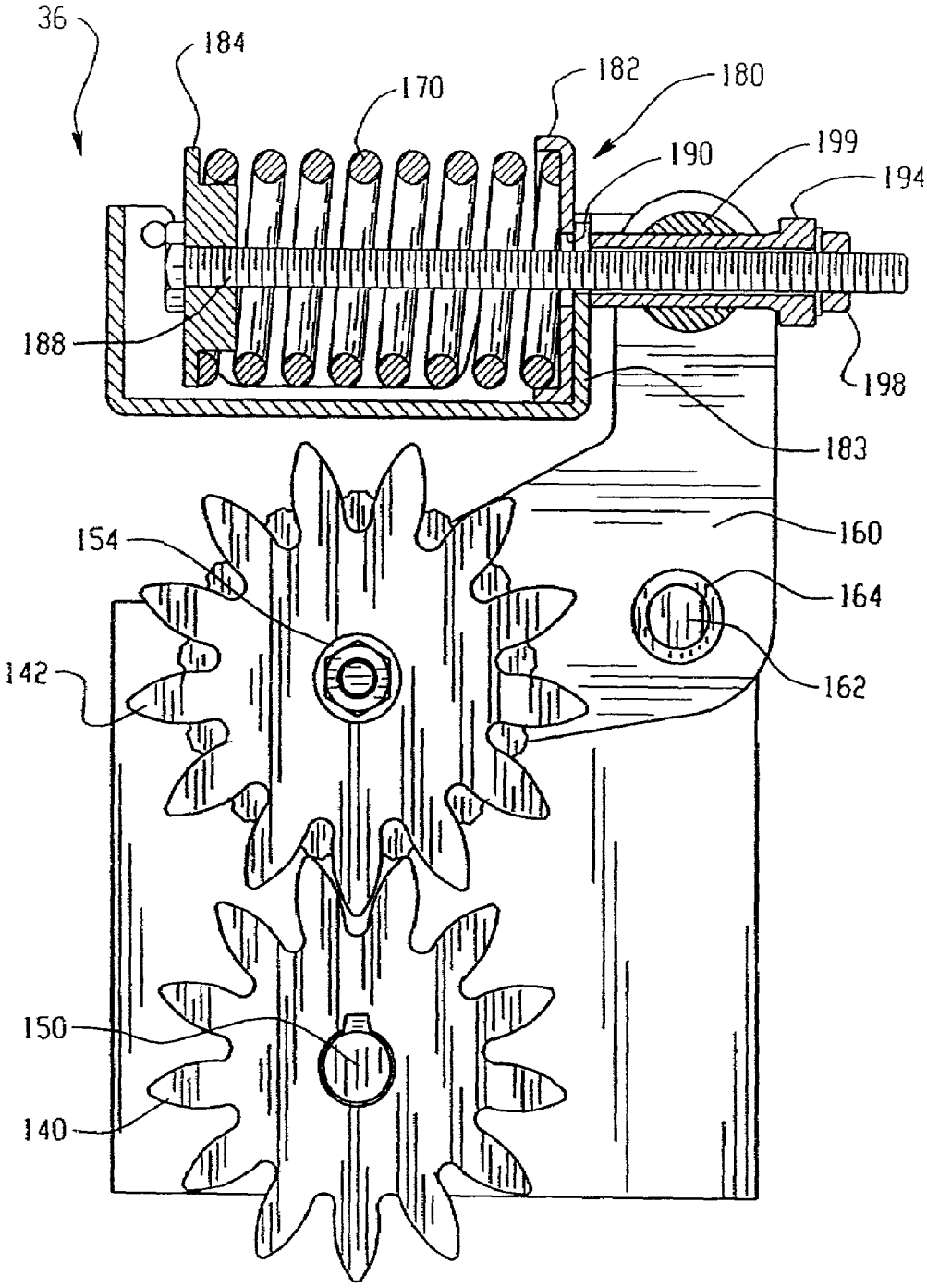
FIG. 8 is a side elevational view, partly in section, of the connecting gear assembly of FIG. 5 showing the connecting gears thereof in cooperative engagement.

In the alternative embodiment shown in FIG. 4, a pair of guide members 90, a support frame 92 of the conversion assembly 20, and a base 94 may be integrally connected to form a unitary construction. In the FIG. 4 embodiment, like reference numerals correspond to like components of the embodiment shown in FIG. 3.

As was alluded to above, the driving rollers 60 are driven by a supply motor 17 coupled to a motion transfer assembly 18. In the illustrated exemplary embodiment, the motion transfer assembly 18 includes a flexible transfer element 100, such as a belt or flexible articulating chain, that is trained over and cooperates with pulleys or sprockets 102 that are coupled to the ends of the respective roll support members 60 to transmit power (in the form of rotational movement) thereto from the supply motor 17. Operating the motor 17 at a constant speed causes the flexible transfer element 100 to simultaneously rotate the roll support members 60 at a constant rotational speed which, in turn, drive the stock roll 14 at a substantially constant speed. As a consequence, the stock material 16 is advanced, or supplied, to the downstream conversion assembly 20 at a substantially constant rate.

The stock supply assembly 11 may supply the stock material 16 at a rate different than the rate at which the stock material 16 is fed through the conversion assembly 20. Thus, the stock supply assembly 11 may be used to supply the stock material 16 at a rate faster than that of the feeding/connecting assembly 36, thereby forming a loose loop in the material 16 between the stock supply assembly 11 and feeding connecting/assembly 36. The feeding/connecting function may then be performed without having to additionally periodically accelerate the stock roll 14. Instead, the feeding/connecting assembly 36 draws stock material 16 from the slack formed therein by the stock supply assembly 11. This allows the feeding/connecting assembly 36 to feed/connect the stock material 16 independent of the weight, size and/or rotation of the stock roll 14.

A sensor 106 may be provided to detect the size of the loop formed in the stock material 16 when operating the stock supply assembly 11 at a faster rate than the feeding/connecting assembly 36. If the sensor detects a loop smaller than a prescribed desired loop size, the motor 17 and motion transfer assembly 18 of the stock supply assembly 11 may then be controlled to accelerate the stock roll 14 so that the stock material 16 advanced therefrom "catches up" and restores the desired loop size, after which the supply speed can be reduced until restoration of the desired loop size is again needed. If desired, the sensor may simply detect when the loop size is smaller or larger than the desired loop size, and provide a signal to a controller for the stock supply respectively to increase or decrease the speed at which stock material is supplied, thereby to maintain the desired loop size.

The stock supply assembly 11 alternatively may drive the stock roll at a supply rate slower than that of the feeding/connecting assembly 36 to effect, for example, a controlled tension in the stock material 16. That is, the feeding/connecting assembly 36 will pull the stock material at a rate faster than it would otherwise be supplied under the driving force of the supply assembly to provide a controlled tension in the stock material.

Referring again to FIG. 3, the illustrated stock supply assembly 11 also includes, downstream of the stock roll holder assembly 12, a pair of constant entry rollers 110 and 112 journalled between the side plates or walls of the triangle-shaped support member 82 that provide a non-varying point of entry for respective plies of the sheet stock material 16 being payed off the stock roll 14. A separating device 116 receives the sheet stock material 16 from the rollers 110 and 112 and separates the multiple plies $P_1$, $P_2$, $P_3$ from one another via spaced apart and transversely extending separator members 120 and 122 prior to passing to the conversion assembly 20 (FIG. 1). In the illustrated embodiment using three ply stock material, the ply $P_1$ is trained around constant entry roller 110 and then around separator member 120. The other two plies $P_2$ and $P_3$ are both trained around constant entry roller 112, but then $P_3$ is passed around separator member 122 and $P_2$ is passed between the separator members 120 and 122, and preferably between the separator member 122 and an intermediate separator member 122.

From the separator members 120,122 and 123 the separated plies $P_1$, $P_2$, $P_3$ pass to the forming assembly 32. The forming assembly 32 causes inward folding of the lateral edges of the sheet stock material 16 to form a continuous strip having lateral pillow portions and a thinner central band. The illustrated exemplary forming assembly 32 shown in FIGS. 1 and 2 includes a forming member 130, such as a forming frame, and a converging shaping chute 132. The shaping chute 132 includes longitudinally extending, transversely converging side walls 134 which preferably are curved or arcuate in transverse cross-section. As the sheet-like stock material is passed through the shaping chute 132, the side edges thereof are turned or rolled inwardly towards one another so that the inwardly turned or rolled edges form resilient pillow-like crumpled portions of stock material disposed in lateral abutting relationship as they emerge from the exit end of the shaping chute. The forming member 130 coacts with the shaping chute 132 to ensure proper shaping and forming of the paper (or other suitable stock material), the forming member being operative to guide the central portion of the stock material 16 along the bottom wall 136 of the shaping chute 132 for controlled inward rolling or folding of the side edge portions of the stock material 16. The forming member 130 projects rearwardly (upstream) of the entry end of the shaping chute 132 for proper guiding of the stock material 16 into the shaping chute 132. The forming member 130 also extends into the shaping chute 132 with its forwardmost end disposed relatively close to the underlying bottom wall 136 of the shaping chute 132 adjacent the exit end of the shaping chute 132, as shown.

Referring again briefly to FIGS. 1 and 2, and further to FIGS. 5 through 9, there is shown the feeding/connecting assembly 36 in accordance with the present invention. In the illustrated embodiment, the feeding/connecting assembly 36 includes a pair of cooperating and opposed gears or gear-like members 140 and 142. The gears 140 and 142, and thus the feeding/connecting assembly 36, perform at least one and preferably two functions in the operation of the machine 10. One function is the previously noted "feeding" function, with the gears pulling the stock material 16 through the forming assembly from the stock supply assembly 11, or directly from the stock roll 14, or from some other source. The material 16 is then discharged by the feeding/connecting assembly 36, passing the below-described severing assembly 46.

The second function preferably performed by the feeding/connecting assembly 36 is a connecting function. Specifically, the feeding/connecting assembly 36 connects the continuous strip via the interaction of the gears 140 and 142, by connecting, as by coining or stitching, the formed stock material 16 along a central band to form a connected strip of cushioning. Other mechanisms may be employed to "connect" the strip, i.e., to form the strip in such a manner that it will retain its cushioning properties as opposed to reverting to the original flat form of the stock material. Known connecting mechanisms include mechanisms that crease the stock material to enable the stock material to hold its three-dimensional crumpled or crinkled shape.

The gears 140 and 142 comprise a driving toothed-wheel gear-like member 140 and a rotating idler toothed-wheel gear-like member 142. The driving gear-like member 140 is mounted on a driving shaft 150 which is journalled at its ends in bearings 151 which, in turn, are mounted in a frame 152 supported by the housing 38 of the conversion assembly 20. The driving shaft 150 is driven by the motor 40 via a motion transfer assembly 42.

The rotating gear-like member 142 is mounted on an idler shaft 154 (FIG. 8) rotatably mounted in a clevis at one end of a generally L-shaped pivot member 160. The pivot member 160 is rotatably mounted at a central portion thereof to a support shaft 162 by bearings or bushings 164 (see FIGS. 8 and 9). The support shaft 162 is connected at its ends to the frame 152. It will be appreciated that the generally L-shaped pivot member 160 may be rotated to thereby move the rotating gear 142 toward (FIG. 8) or away (FIG. 9) from the driving gear 140 to allow, for example, paper jams to be easily resolved.

The pivot member 160 and, consequently, the rotating gear 142 is resiliently urged towards the driving gear 140 by a spring 170. While a coil spring is shown in the exemplary embodiment, alternative types of biasing means, such as a leaf spring, may be used, and such alternatives are contemplated as falling within the scope of the claimed invention. The resilient spring bias force substantially continuously maintains the rotating gear 142 in cooperative relationship with the driving gear 140 during a conversion process.

The spring 170 is carried by a mounting assembly, generally indicated by the reference number 180. More particularly, the spring 170 is interposed between a bearing plate 182 and an adjustable stop 184 of the mounting assembly 180. In operation, the spring 170 and the corresponding mounting assembly 180 are oriented in a position parallel to the path of travel of the stock material 16 passing through the conversion assembly 20.

The bearing plate 182 is connected to a mounting bracket 183 which, as described below, either limits movement in the pivot member 160 to within a prescribed range of positions or permits the free rotation thereof. The adjustable stop 184 has an opening therein for slidably receiving therethrough an adjusting bolt 188. The adjusting bolt 188, in turn, extends through an opening 190 in the bearing plate 182 and is slidably received in a sleeve 194 forming part of the pivot member 160 and disposed in abutting relationship with the mounting bracket 183. The opening 190 in the bearing plate 182 is slightly larger than the diameter of the adjusting bolt 188 to allow the bolt 188 to laterally shift due to, for example, flexing in the spring 170 during a conversion process.

The spring tension of the spring 170 may be adjusted by adjusting an adjusting nut 198 attached to the threaded end of the adjusting bolt 188. As will be appreciated, tightening the adjusting nut 198 causes the nut 198 to bear down on the sleeve 194 and draw the adjustable stop 184 closer to the bearing plate 182 which, in turn, compresses the spring 170 to thereby raise the spring tension thereof. In a similar manner, the adjusting nut 198 may be loosened to thereby lower the tension in the spring 170.

The sleeve 194 is threaded for receipt in a threaded bore in a swivel member 199 provided at an end of the pivot member 160 opposite the end to which the gear 142 is mounted. The sleeve can be rotated in the swivel member to adjust the minimum spacing between the gears 140 and 142 as desired.

The mounting bracket 183 is mounted to the support shaft 162 by a pair of adjusting rings 200 which provide for lateral adjustment of the mounting bracket for aligning the idler gear 142 with the driving gear 140. Of course, this alignment can be accomplished in other ways.

Figure 9:
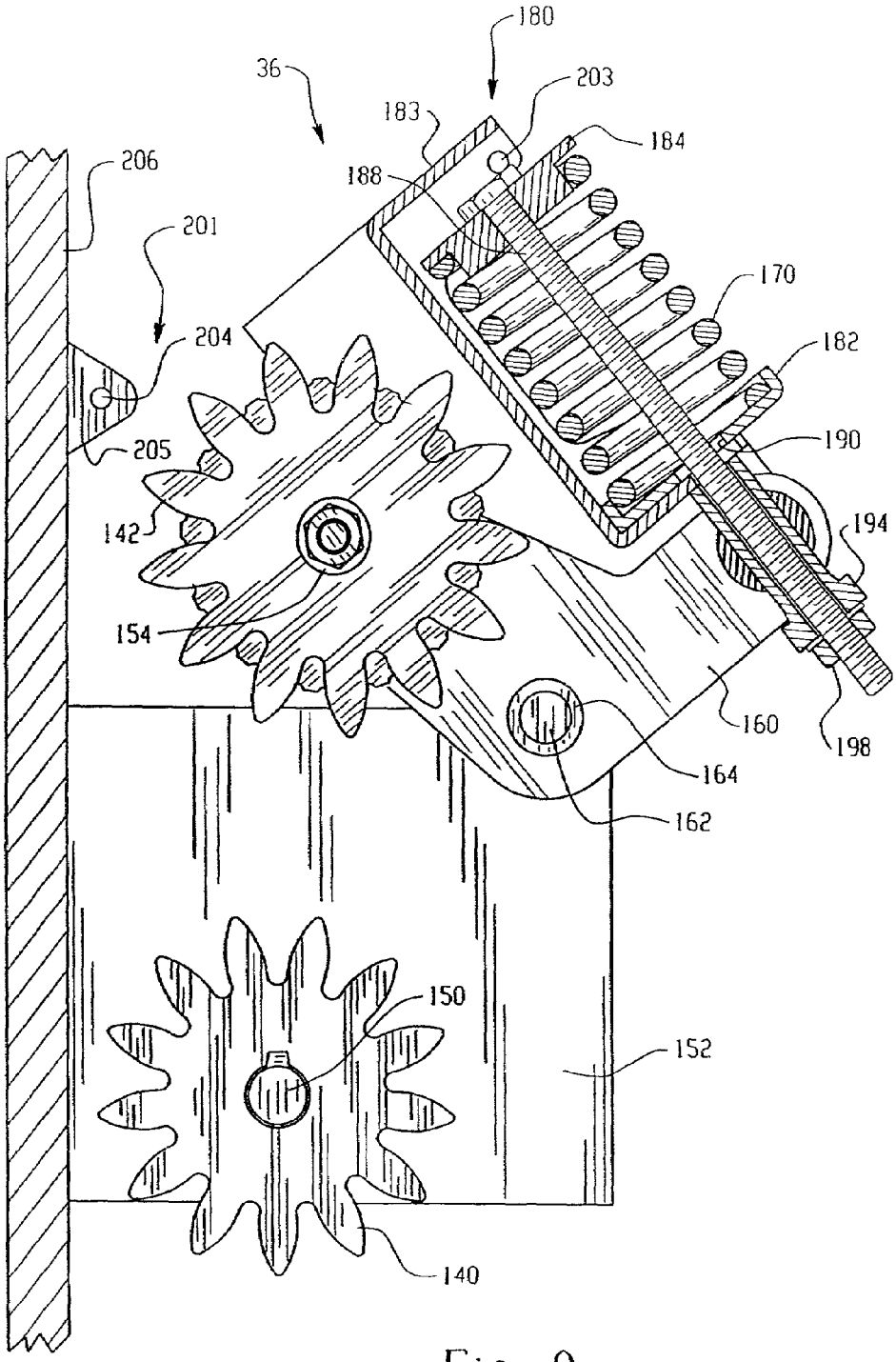
FIG. 9 is a side elevational view similar to that of FIG. 8, but showing the connecting gears thereof separated.

The support shaft 162 is mounted between side plates of the frame 152 for permitting pivoting of the mounting bracket 183 about the axis of the support shaft between an operating position (FIG. 8) and a release position (FIG. 9). The mounting bracket is retained in the operating position by a locking device 201. The locking device preferably includes a quick connect/disconnect pin 202 that may be inserted through aligned openings 203 and 204 respectively provided in the mounting bracket 183 and a mounting lug 205. The mounting lug may be in the form of a clevis mounted to the machine frame end plate 206 (FIGS. 2 and 9). The pin 202 may be removed to permit swinging of the mounting bracket 183 to its FIG. 9 position, as for clearing a jam.

Figure 10:
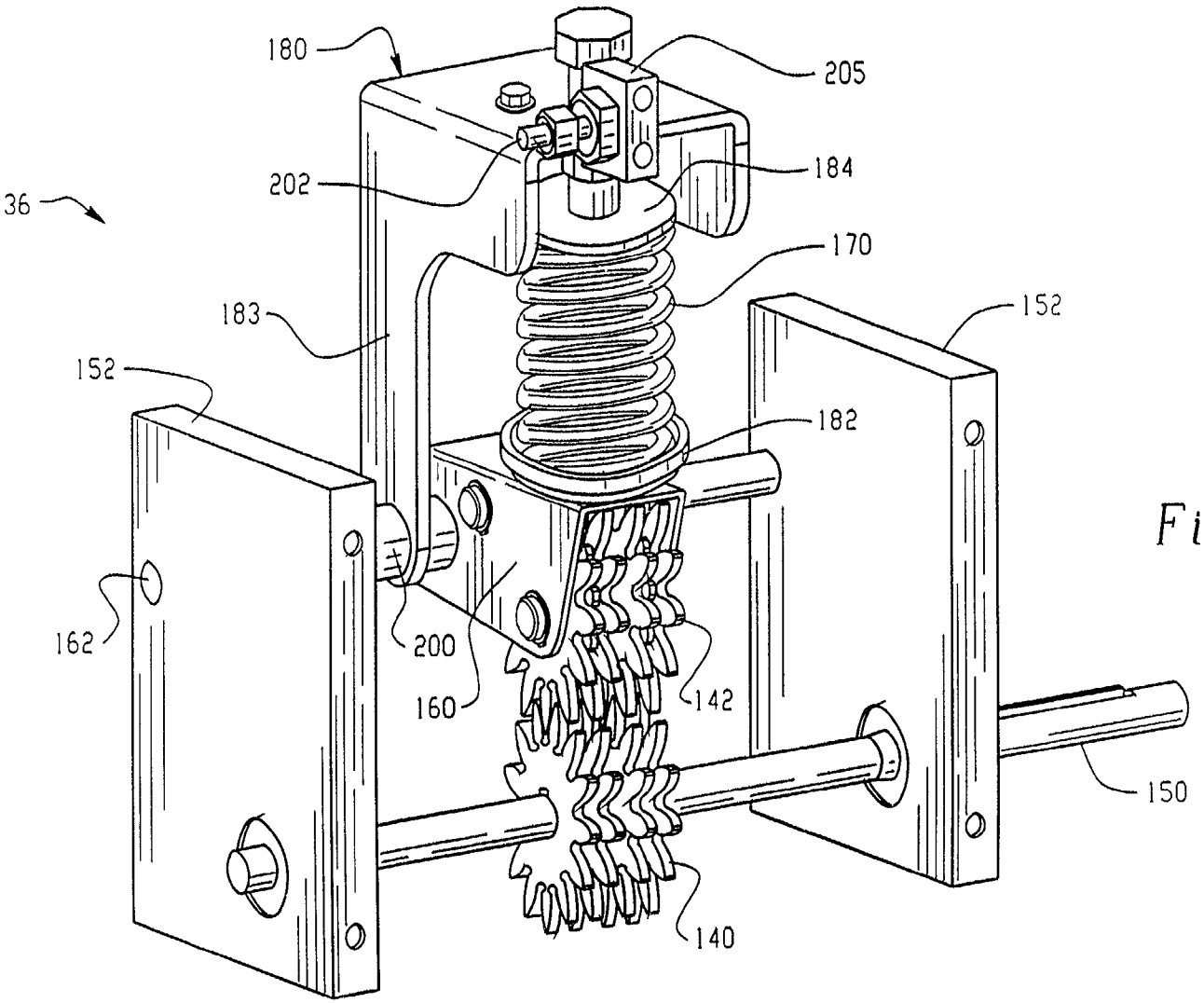
FIG. 10 is a perspective view of another embodiment of a connecting gear assembly.

FIG. 10 shows an alternative embodiment of the feeding/connecting assembly, indicated generally at 202. Here, in an operating position the spring 170 and the corresponding mounting assembly 180 are oriented in a position that is substantially perpendicular to the path of travel of the stock material 16 passing through the conversion assembly 20. The various components of the alternative embodiment function and interrelate in a manner substantially similar to that of the embodiment shown in FIGS. 5–9. To this end, like reference numerals correspond to like components in the Figures. Depending on the size and dimensioning of the conversion machine 10 and other components, one embodiment may be more desirable than the other.

The illustrated embodiments of a feeding/connecting assembly 36 according to the present invention realize several advantages over known prior art feeding/connecting mechanisms. The feeding/connecting assembly 36 utilizes a relatively large spring, extending the fatigue life of the assembly 36 further than if a conventional smaller spring were used. In a preferred embodiment, the life cycle of the spring is about five years. The structure and relative orientation of the components of the feeding/connecting assembly 36 provide greater stability and rigidity, better enabling the feeding/connecting assembly 36 to withstand the rigors associated with converting sheet stock material, especially heavier grade sheet stock material. Also, the use of a single spring provides for easy linear measurement and therefore adjustment of the spring tension in the spring 170.

Figure 11:
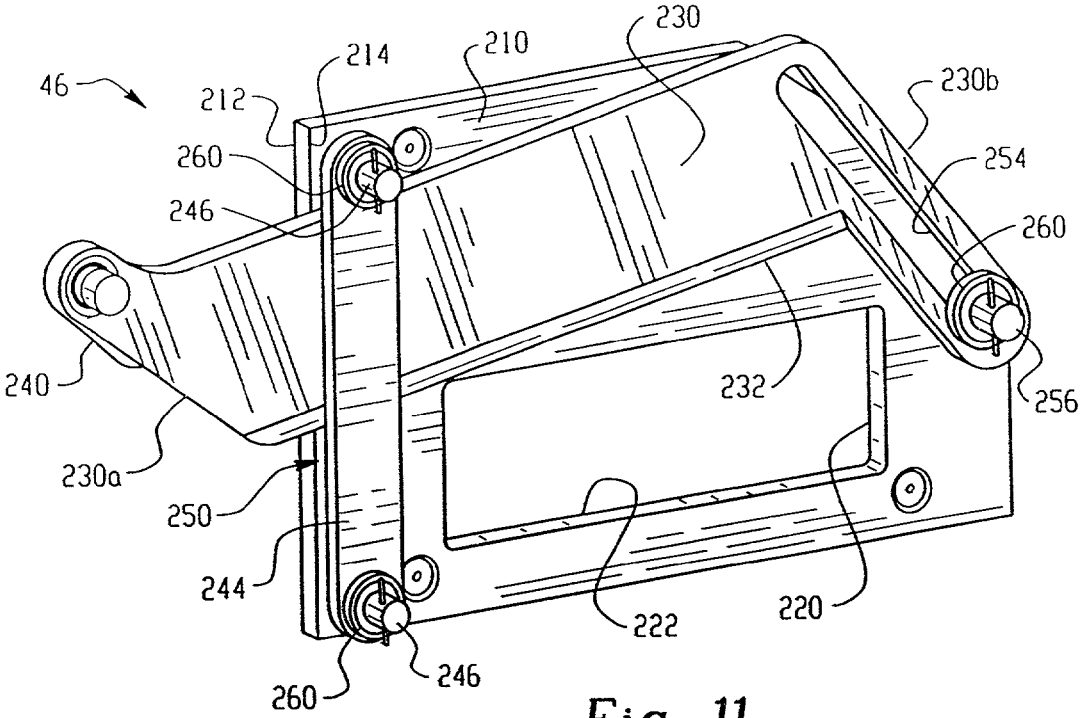
FIG. 11 is a perspective view of a severing assembly forming part of the cushioning conversion machine of FIG. 1.
Figure 12:
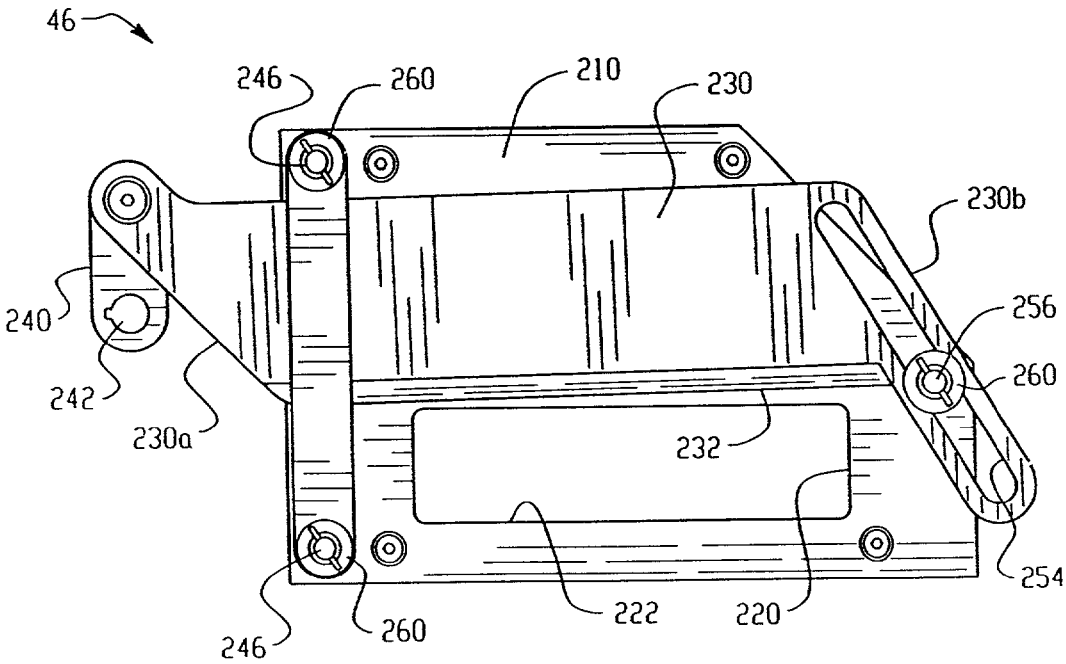
FIG. 12 is a downstream end view of the severing assembly of FIG. 11, shown in a different position.
Figure 14:
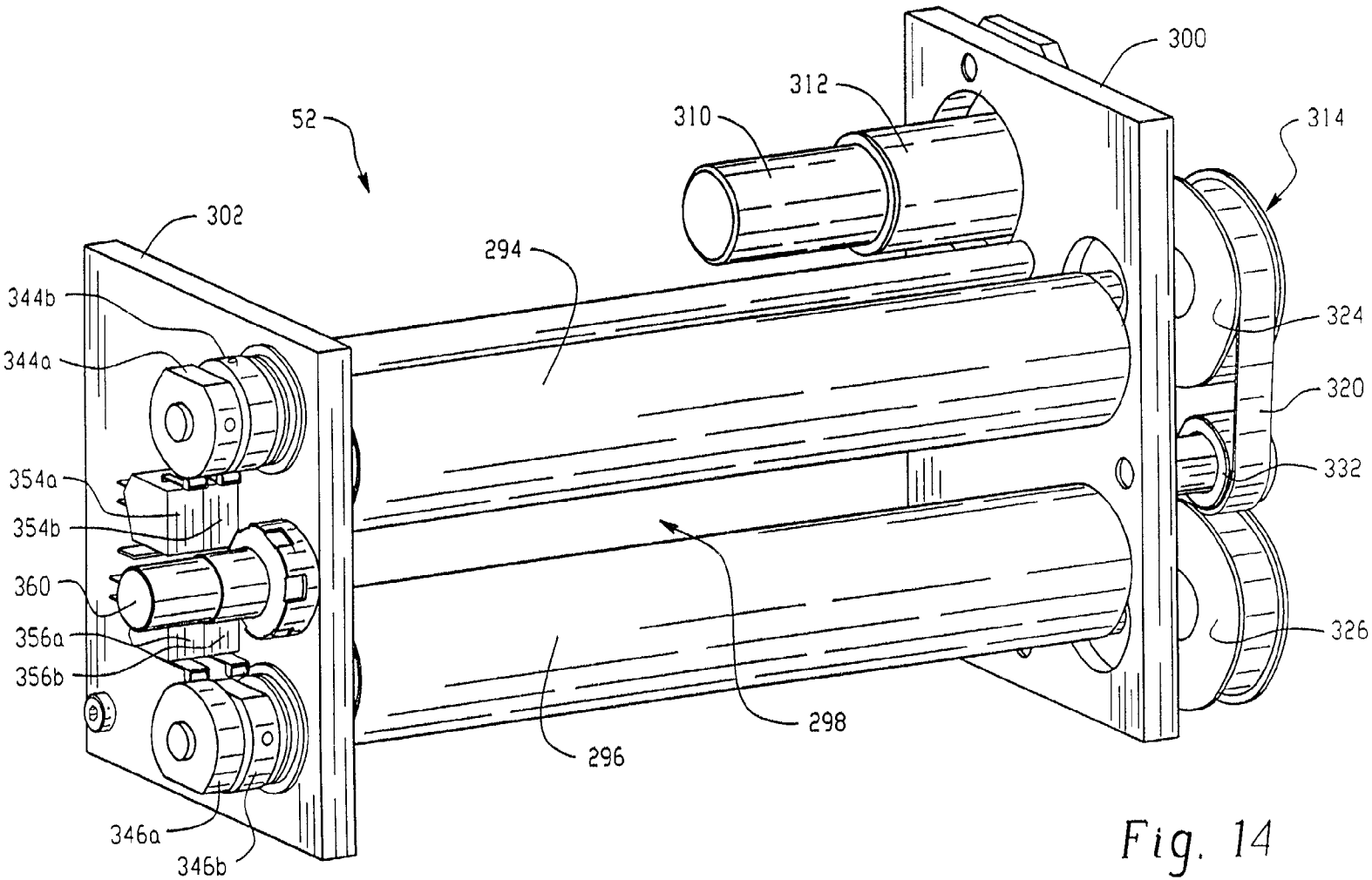
FIG. 14 is a perspective view of a shutter device forming part of the cushioning conversion machine of FIG. 1, the shutter device being shown in a closed position.
Figure 15:
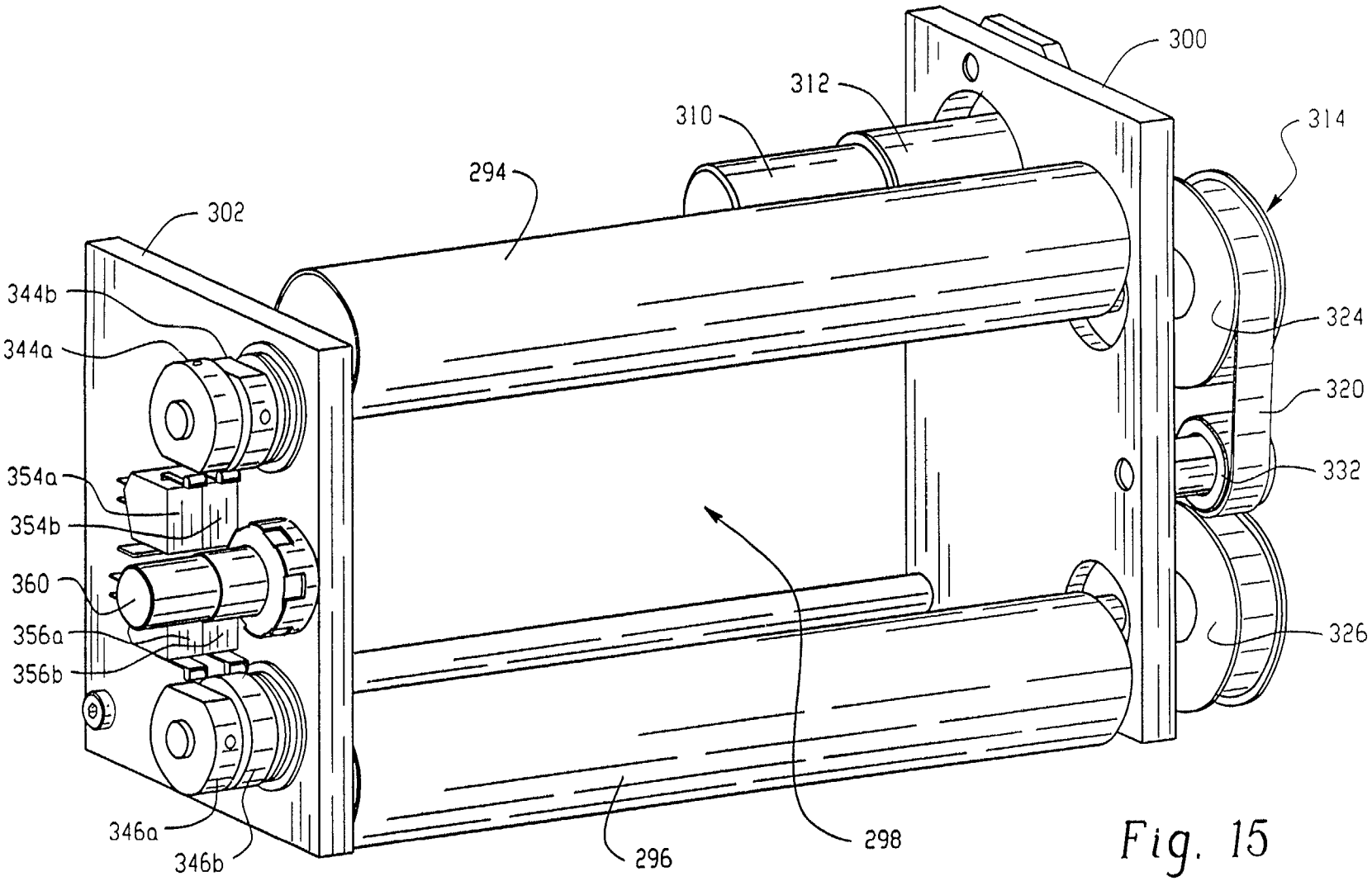
FIG. 15 is a perspective view of the shutter device of FIG. 14, the shutter device being shown in an open position.

From the feeding/connecting assembly 36, the connected strip travels downstream to the severing assembly 46 which severs, for example by cutting, the strip into a section of a desired length. Referring to FIGS. 11–13, the severing assembly 46 includes an end plate 210, preferably made of metal plate material, mounted to and/or in the housing 38 of the conversion assembly 20. The end plate 210 has an upstream side 212 and a downstream side 214 and includes an outlet opening 220 therein through which the continuous strip of dunnage passes. The outlet opening 220 is preferably generally rectangular shape and has at least one side thereof forming a severing edge 222. The end plate 210 and its corresponding outlet opening 220 lie in a plane perpendicular to the path of travel of the stock material 16.

A generally S-shaped movable blade 230, likewise preferably made of metal plate material, is mounted to the downstream side 214 of the end plate 210 for movement between an open position and a closed position. A straight portion of the blade 230 forms a severing edge 232. In the open position (frame sequence number 1 in FIG. 13), the strip of cushioning may pass through the outlet opening 220. As the blade 230 moves to its closed position (frame sequence numbers 6–7 in FIG. 13), the severing edge 232 of the blade 230 coacts with the severing edge 222 of the outlet opening 220 thereby to sever fully the strip of cushioning.

The movable blade 230 has one end 230*a* (the "left end" in FIGS. 11–12) that is pivotally coupled to a distal end of a motion crank 240. The motion crank 240 is connected to a shaft 242 powered by the motor and motion transfer assembly 48 (FIG. 2). In operation, the motion crank 240 imparts a circular motion to the left end 230*a* of the movable blade 230. A guide bar 244 is mounted to the end plate 210 by suitable fasteners 246 to form a guideway 250 for slidably receiving the movable blade 230. The other end 230*b* (the "right end" in FIGS. 11–12) of the movable blade 230 includes a slot 254 for slidably engaging a suitable fastener 256, such as a pin member or shoulder bolt, mounted to the end plate 210. The slot 254 cooperatively engages the fastener 256 to provide a reciprocal movement of the right end 230*b* of the movable blade 230 along the path defined by the slot 254 which, in the illustrated embodiment, defines a linear path. The combination of the circular movement of the left end 230*a* of the movable blade 230 and the linear translating movement of the right end 230*b* of the movable blade 230 causes the blade 230 to move as shown in the illustrated sequence of movements in FIGS. 13/1–13/16. It will be appreciated that one rotation of the shaft 242 will move the movable blade 230 from its open position to its closed position and back to its open position.

The fasteners 246 and 256 have associated therewith disc springs 260 (e.g. wave springs, Belleville washers, etc.) which resiliently bias the movable blade 230 and its severing edge 232 against the downstream side 214 of the end plate 210. The fasteners 246 and 256 and spring bearings 260 may be adjusted to increase or decrease the biasing force on the movable blade 230.

Several advantages are realized over previously known severing assemblies by the severing assembly 46 of the present invention. The severing assembly 46 is made of relatively few and simple components, making the manufacturing, assembly and adjusting thereof relatively simple. The components are designed for stability and rigidity to sustain the rigors associated with converting sheet stock material, especially heavier grade sheet stock material. The limited number of parts also reduces costs and simplifies maintenance of the severing assembly 46.

Referring now to FIGS. 14–17, the severed section of connected dunnage travels through a post-severing guide assembly 280 (FIGS. 16–17), which includes a converging portion 284 and a rectangular tunnel portion 288 that together form an exit chute. The coined or otherwise connected strip then emerges from the post-severing guide assembly 280 where an operator may remove the coined strip from the conversion machine 10.

Figure 17:
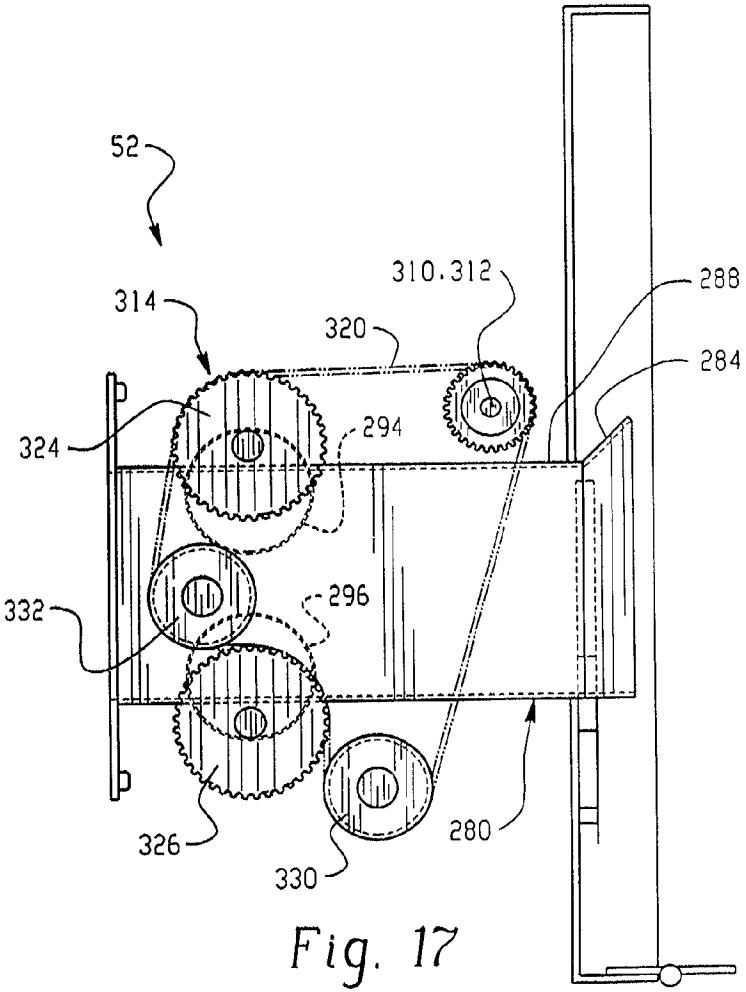
FIG. 17 is a schematic side elevational view of the shutter device of FIG. 14 showing the driving system thereof.
Figure 16:
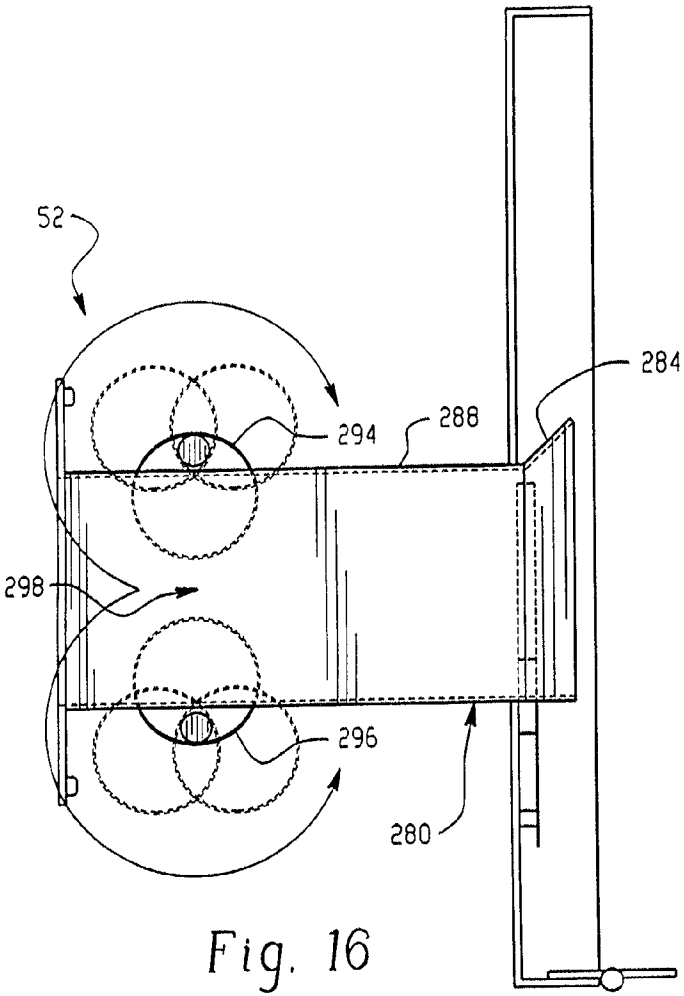
FIG. 16 is a schematic side elevational view of the shutter device of FIG. 14 showing the direction of rotation of the eccentric rollers thereof.

As shown in FIGS. 16–17, a shutter or closure device 52 is disposed at a downstream end of the post-severing guide assembly 280 and upstream of the exit opening of the conversion machine 10. The shutter device 52 permits the cushioning product to be fed out, in one direction, through the exit opening of the cushioning conversion machine 10 but inhibits access to the severing assembly 46, in the opposite direction, inwardly through the exit opening.

The shutter device 52 includes a pair of eccentric rollers 294 and 296 disposed substantially parallel to one another to form a variable rectangular-shaped gap 298 therebetween. The rollers 294 and 296 may be rotated between an "open" position (FIG. 15) with the gap 298 enlarged to permit free passage therethrough of a section of dunnage and a "closed" position (FIG. 14) with the gap 298 reduced in size to inhibit foreign objects from entering the post-severing guide assembly 280 and the severing assembly 46 from the outside thereof.

The eccentric rollers 294 and 296 are rotatably mounted at their ends to a pair of mounting plates 300 and 302 forming opposite sides of the tunnel portion of exit chute. The mounting plates are connected to and/or in the housing 38 of the conversion assembly 20. As shown in FIG. 16, the rollers 294, 296 are oriented relative to one another so that when the offset portion of the roller 294 is directed downward, the offset portion of the roller 296 is directed upward, and vice versa.

The rollers 294, 296 are driven by a motor 310 and reducer 312 coupled to a motion transfer assembly 314, which are mounted to the mounting plate 300. As shown in FIG. 17, the motion transfer assembly 314 comprises a flexible transfer element 320, such as a double-sided belt or flexible articulating chain, that is trained over and cooperates with pulleys or sprockets 324, 326 that are coupled to the ends of the respective eccentric rollers 294, 296 to transmit power (in the form of rotational movement) thereto from the motor 310 and reducer 312. A pair of idler pulleys or sprockets 330 and 332 are disposed relative to the pulley or sprocket 326 so that the "backside" of the flexible transfer element 320 is trained over the pulley or sprocket 326, thereby causing the pulley or sprocket 326 and, consequently, the eccentric roller 296 to rotate in a direction opposite that of the eccentric roller 294. As viewed in FIG. 17 of the illustrated embodiment, clockwise rotation of the motor 310 causes simultaneous counterclockwise rotation of the eccentric roller 296 and clockwise rotation of the eccentric roller 294.

Because the eccentric roller 294 turns clockwise as the eccentric roller 296 turns counterclockwise as shown in FIG. 16, the shutter device 52 of the present invention also operates to positively engage the leading edge of a severed strip of dunnage and push the severed strip from the post-severing guide assembly 280.

At the other end of the shutter device 52, the eccentric rollers 294, 296 have mounted on their ends for rotation therewith respective cam discs 344*a*, 344*b*, 346*a* and 346*b*. The cam discs 344*a*, 344*b*, 346*a* and 346*b* cooperate with respective switches, preferably microswitches 354*a*, 354*b*, 356*a* and 356*b*, to detect whether the eccentric rollers 294, 296 are in an open position or a closed position. For example, when the shutter device 52 is in its closed position (FIG. 14) the switches 354*a* and 356*a* are actuated and the switches 354*b* and 356*b* are non-actuated, indicating that the offset portions of the eccentric rollers 294 and 296 are directed inwardly toward each other. Similarly, when the shutter device 52 is in its open position (FIG. 15) the switches 354*b* and 356*b* are actuated and the switches 354*a* and 356*a* are non-actuated, indicating that the offset portions of the eccentric rollers 294 and 296 are directed outwardly away each other. This information is communicated to the controller of the conversion machine 10 which, in turn, controls the starting and stopping, as desired, of the motor 310, reducer 312 and motion transfer assembly 314.

A photocell 360 is mounted to the mounting plate 302 for photodetection of the presence of a section of dunnage residing in the gap 298 between the eccentric rollers 294 and 296. The photocell may be used in a known manner for automatic production of a new pad when a pad is removed from the exit chute.

Although the invention has been shown and described with respect to certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A cushioning conversion machine comprising a conversion assembly which converts sheet stock material into a three-dimensional cushioning product, the conversion assembly including a frame and a connecting assembly, the connecting assembly comprising:

first and second rotating feed members, the first of which is mounted in a carrier pivotally mounted to the frame for movement between an operative position and an inoperative position;

a biasing member disposed between the frame and the carrier for exerting a biasing force against the carrier when the carrier is in its operative position;

a releasable locking device which, in a locked position, resiliently holds the carrier in its operative position thereby to bias the first rotating feed member towards the second rotating feed member, and in an unlocked position allows the carrier to be pivoted from its operative position to its inoperative position to move the first rotating feed member away from the second rotating feed member.

2. A cushioning conversion machine as set forth in claim 1, wherein the carrier is pivotally connected to a pivot shaft and rotatably supports an idler shaft, the idler shaft carrying the first rotating feed member.

3. A cushioning conversion machine as set forth in claim 2, further including a driving shaft rotatably mounted to the frame and having the second rotating feed member carried thereon.

4. A cushioning conversion machine as set forth in claim 3, wherein the carrier, when in its operating position, is resiliently biased to urge the idler shaft and the first feed member carried thereon toward the driving shaft and the second feed member carried thereon so as to apply a pinch force to stock material being fed between the feed members.

5. A cushioning conversion machine as set forth in claim 3, wherein, when the releasable locking device is in its unlocked position, the carrier is selectively adjustable in such a manner that the idler shaft is movable towards and away from the driving shaft for adjusting the distance between the first rotating feed member and the second rotating feed member.

6. A cushioning conversion machine as set forth in claim 1, further including a mounting assembly movable between a locked condition whereat the carrier may pivot about the frame over a prescribed angular range, and a released condition whereat the mounting assembly is free to pivot about the frame and carry along with it the carrier.

7. A cushioning conversion machine as set forth in claim 6, wherein the biasing member is interposed between the carrier and mounting assembly for resiliently biasing the carrier relative to the mounting assembly so that, when the releasable locking device is in its locked position, the biasing member urges the first rotating feed member toward the second rotating feed member.

8. A cushioning conversion machine as set forth in claim 1, wherein the biasing member comprises a coil spring.

* * * * *